US006101994A

United States Patent [19]

Ichikawa

[11] Patent Number: 6,101,994

[45] Date of Patent: Aug. 15, 2000

[54] CYLINDER BLOCK STRUCTURE

[75] Inventor: Hiroyuki Ichikawa, Fujisawa, Japan

[73] Assignee: Isuzu Motors Limited, Tokyo, Japan

[21] Appl. No.: 09/224,911

[22] Filed: Jan. 4, 1999

[30] Foreign Application Priority Data

Jan. 12, 1998 [JP] Japan ..... 10-004144

[51] Int. Cl.[7] ..... F02F 7/00

[52] U.S. Cl. ..... 123/195 R; 123/41.72

[58] Field of Search ..... 123/195 R, 41.42, 123/41.72, 41.74

[56] References Cited

U.S. PATENT DOCUMENTS

| | | | |
|---|---|---|---|
| 4,515,112 | 5/1985 | Tsuchiya et al. . | |
| 4,686,943 | 8/1987 | Anno et al. | 123/41.74 |
| 4,702,204 | 10/1987 | Anno et al. . | |
| 4,712,517 | 12/1987 | Anno et al. . | |
| 5,842,447 | 12/1998 | Krotky et al. | 123/195 R |

FOREIGN PATENT DOCUMENTS

WO 96 19655 6/1996 WIPO .

*Primary Examiner*—John Kwon

*Attorney, Agent, or Firm*—McCormick, Paulding & Huber LLP

[57] ABSTRACT

An aluminum cylinder block (1) of an engine has a plurality of cylinder bores (2), and intermediate marginal areas (17) defined between adjacent cylinder bores (2). A single water jacket (8) is formed in the cylinder block (8) to surround the plurality of cylinder bores (2), and a plurality of oil chutes (15) are also formed in the cylinder block (1) outside the water jacket (8) for allowing an oil to drop from a cylinder head (5) to a crankcase (14) therethrough. These oil chutes (15) are formed between adjacent intermediate marginal areas (17) so that they do not make the cylinder block (1) swell out. An air in the oil chutes (15) functions as a sound insulation layer against combustion noises generated in the cylinder bores (2). The air in the oil chutes (15) also serves as a heat insulation layer for a cooling water in the water jacket (8) so that warming up performance of the engine under a cold condition is improved.

10 Claims, 3 Drawing Sheets

PRIOR ART

CYLINDER BLOCK STRUCTURE

BACKGROUND OF THE INVENTION

1. Field of the Invention

The present invention generally relates to a cylinder block structure for an engine and more particularly to a cylinder block structure which can reduce noises radiation from the engine.

2. Description of the Related Art

One of conventional cylinder blocks for an engine is disclosed in, for example, Japanese Utility Model Registration No. 2,514,559 entitled "CYLINDER BLOCK STRUCTURE" issued to Suzuki Kabushiki Kaisha of Shizuoka, Japan. Referring to FIG. 6 of the accompanying drawings, illustrated is the first drawing of this prior art reference. In this conventional cylinder block structure, a single cooling water jacket c and a plurality of oil dropping passages or chutes d are formed in a cylinder block a of an engine. The water jacket c extends surrounding a plurality of cylinder bores e and defines cylinder bore walls b around the cylinder bores e respectively. Intermediate marginal areas g are defined between adjacent cylinder bores e. The oil chutes d connect a cylinder head (not shown) to a crankcase f such that an oil descends into the crankcase f from the cylinder head and a blow-by gas ascends into the cylinder head from the crankcase f. In the conventional arrangement, the oil chutes d are formed in the areas g between adjacent cylinder bores e in order to effectively use these areas g.

In recent years, cylinder blocks are often fabricated of aluminum, instead of cast iron, to reduce the weight of the engine. However, the aluminum is weaker than the cast iron so that if the cylinder block a shown in FIG. 6 is made of aluminum, noises generated upon combustion in the cylinder bores e penetrate a cylinder block wall h and leak to the outside. These noises are significant in diesel engines (particularly diesel engines equipped with a supercharger) of which combustion pressure in the cylinder bores e is high.

In addition to the oil chutes d, cylinder head bolt holes i are also formed in the intermediate marginal areas g of the cylinder block a for bolts connecting the cylinder head with the cylinder block a. In actuality, therefore, the intermediate areas g cannot be used solely for the oil chutes d, and a thicker wall is required to accommodate the oil chutes d. Accordingly, the cylinder block a swells out partly and occupies a relatively large space in an engine room. Moreover, bulk heads (not shown) exist between adjacent cylinder bores e so that the cylinder block a should be designed to avoid the bulk heads. This also makes the cylinder block a expand outward and occupy a large space in the engine room.

SUMMARY OF THE INVENTION

One object of the present invention is to provide a cylinder block structure which can realize both noise reduction and weight reduction.

Another object of the present invention is to provide a cylinder block structure which can attain both noise reduction and size reduction.

According to one aspect of the present invention, there is provided a cylinder block structure for an engine comprising: a cylinder block having a plurality of cylinder bores with intermediate marginal areas being defined between adjacent cylinder bores, a water jacket formed in the cylinder block around the cylinder bores, a plurality of oil chutes formed in the cylinder block outside the water jacket at positions between the intermediate marginal areas for allowing an oil to drop from a cylinder head to a crankcase through the oil chutes. The oil chutes are generally arranged along the water jacket. Combustion noises generated in the cylinder bores are absorbed by an air in the oil chutes. Therefore, noise radiation from the engine is reduced. In other words, the air layer in the oil chutes serves as a sound insulation layer against the combustion noises of the engine. Since the water jacket surrounds the cylinder bores and the oil chutes are formed along the water jacket, the oil chutes also surround the cylinder bores which are the origins of noises. Accordingly, these oil chutes can reduce the combustion noises effectively.

In addition, heat radiation from the water in the water jacket is also insulated by the air layer in the oil chutes. Therefore, warming up performance of the engine under a cold condition is particularly improved. In other words, the air layer in the oil chutes also serves as a heat insulation layer for the water flowing in the water jacket (or for the cylinder bores surrounded by the water jacket). Since the oil chutes extend along the water jacket, they can cover a substantial part of the water jacket. Thus, the oil chutes can insulate heat radiation effectively.

Moreover, since the oil chutes are formed between the intermediate marginal areas of the cylinder bores along the water jacket, they do not make the cylinder block swell out unlike the conventional structure. Consequently, the cylinder block of the invention does not occupy a large space in an engine room and it is possible to utilize an engine room effectively. Interference with bulk heads partitioning the cylinder bores is also unnecessary to concern. Therefore, it is feasible to design the cylinder block in a smaller size and a freedom in location of the engine in the engine room is increased.

Corridors or grooves may be formed in the top deck of the cylinder head in the intermediate areas such that they guide an oil dropping from the cylinder head onto the cylinder head top deck into the oil chutes. Vertical oil passages formed in the cylinder head often deviate from the vertical oil chutes formed in the cylinder block since intake and exhaust ports formed in the cylinder head determine the locations of the oil passages of the cylinder head. With the grooves formed in the cylinder head top deck, however, it is insured that the oil is guided into the cylinder block's oil chutes from the cylinder head's oil chutes even if the latter oil chutes do not match the former oil chutes when the cylinder head is assembled onto the cylinder block.

Bridges may be provided over the oil chutes of the cylinder block such that they are coplanar to the top deck of the cylinder block. The bridges may extend in a width direction of the cylinder block. These bridges add a certain amount of area to the top deck which is to be in contact with the cylinder head when assembled. Accordingly, a pressure acting on a gasket interposed between the cylinder head and cylinder block prevails widely, and sealing between the cylinder head and cylinder block is improved.

In the height direction of the cylinder block, the bridges may extend from the top deck of the cylinder block down to a skirt of the cylinder block (or extend an entire length of the associated cylinder bore). These bridges function as ribs to reinforce the cylinder block. Particularly rigidity in the axial direction of the associated cylinder bore is enhanced. Thus, deformation of the cylinder bores can be prevented even if the cylinder block is made of relatively weak material such as aluminum.

It should be noted that the cylinder block may be fabricated of aluminum or cast iron.

DETAILED DESCRIPTION OF THE INVENTION

Now an embodiment of the present invention will be described in reference to the drawings.

Figure 1:
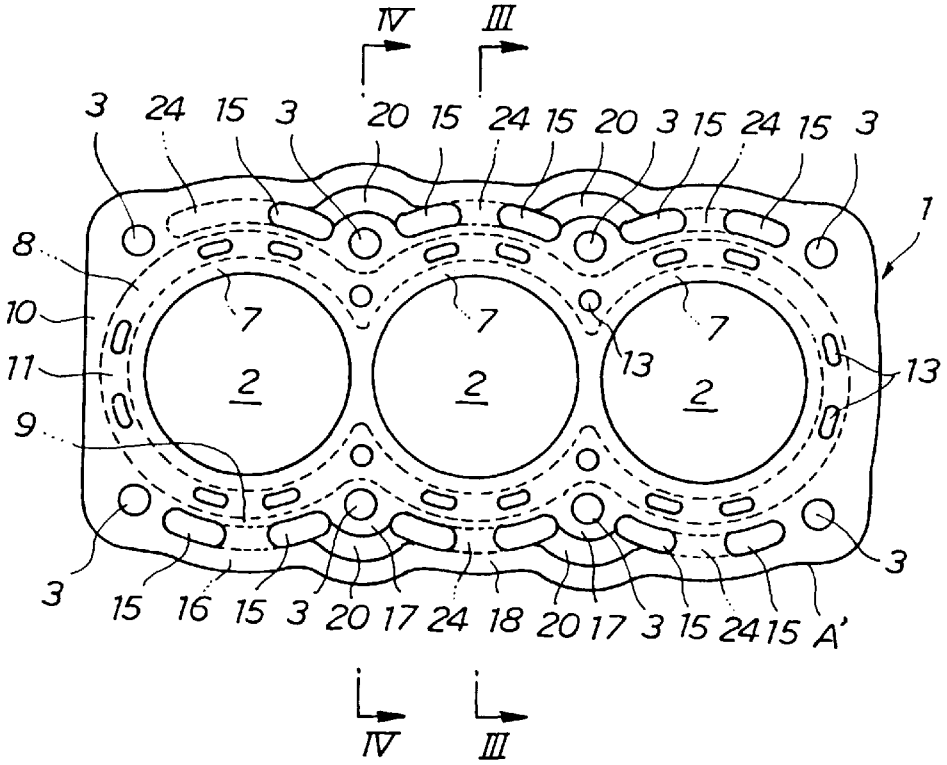
FIG. 1 illustrates a plan view of a cylinder block according to one embodiment of the present invention.

Referring to FIG. 1, illustrated is an aluminum cylinder block 1 according to the present invention. The cylinder block 1 includes three cylinder bores 2 in series, and intermediate marginal areas 17 are defined between adjacent cylinder bores 2. Four cylinder head bolt holes 3 are formed around each cylinder bore 2. These cylinder head bolt holes 3 are spacedly arranged in the intermediate marginal areas (inter-bore marginal areas) 17 in directions parallel to a crankshaft (not shown). Specific locations of the head bolt holes 3 are as follow: two on the left side, two between the left and center cylinder bores 2, two between the center and right cylinder bores 2 and two on the right side in FIG. 1. It should be noted that the left side may be a front side of the engine and the right side may be a rear side. The illustrated cylinder block 1 may be one of two symmetrical cylinder blocks for a V-6 engine.

Figure 4:
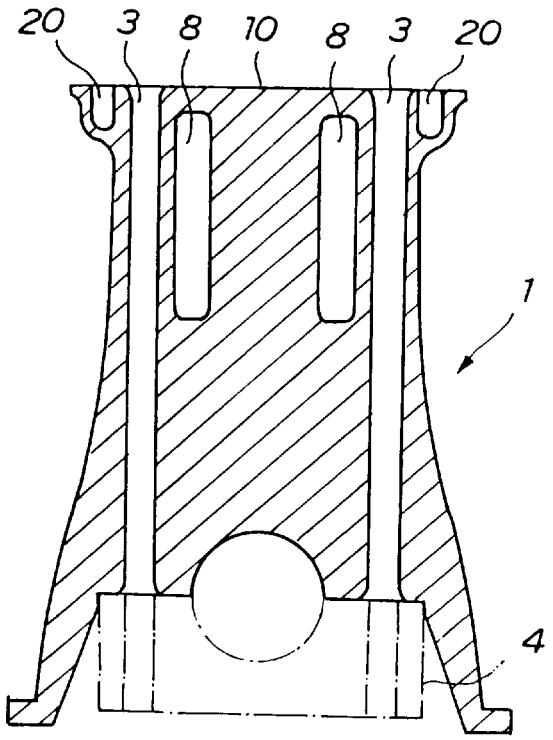
FIG. 4 illustrates a cross sectional view as taken along the IV—IV line.
Figure 5:
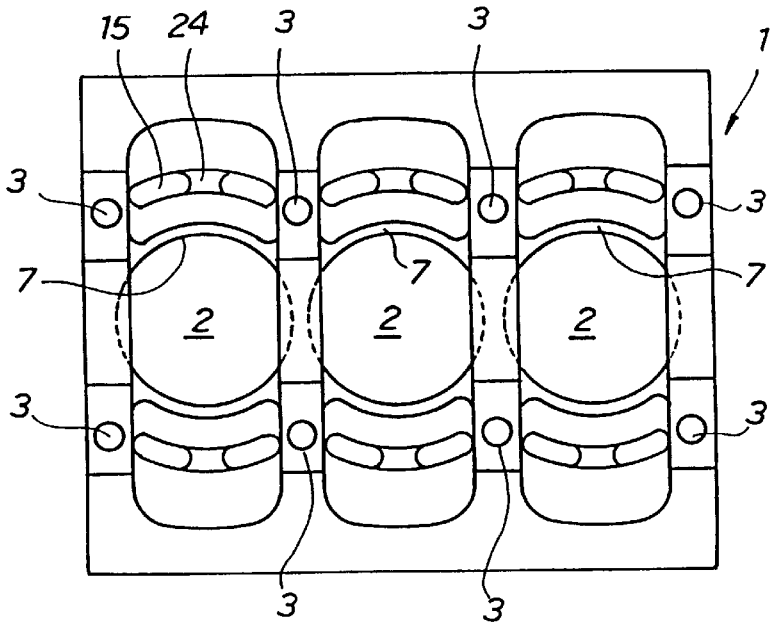
FIG. 5 illustrates a bottom view of the cylinder block shown in FIG. 1.

Referring to FIG. 4, the head bolt holes 3 vertically penetrate the cylinder block 1 from its top to bottom. Cylinder head bolts (not shown) inserted in the head bolt holes 3 also serve as bolts for securing bearing caps 4 on a bottom of the cylinder block 1. Specifically, the cylinder head bolts are inserted from the bottom of the cylinder block 1, penetrate the cylinder block 1 and are screwed into head bolt holes 6 (FIG. 2) of a cylinder head 5.

Referring back to FIG. 1, three continuous cylinder bore walls 7 are formed around the three cylinder bores 2 respectively like a frame for triplicate opera glasses. A single cooling water jacket 8 is formed around the cylinder bore walls 7.

Figure 3:
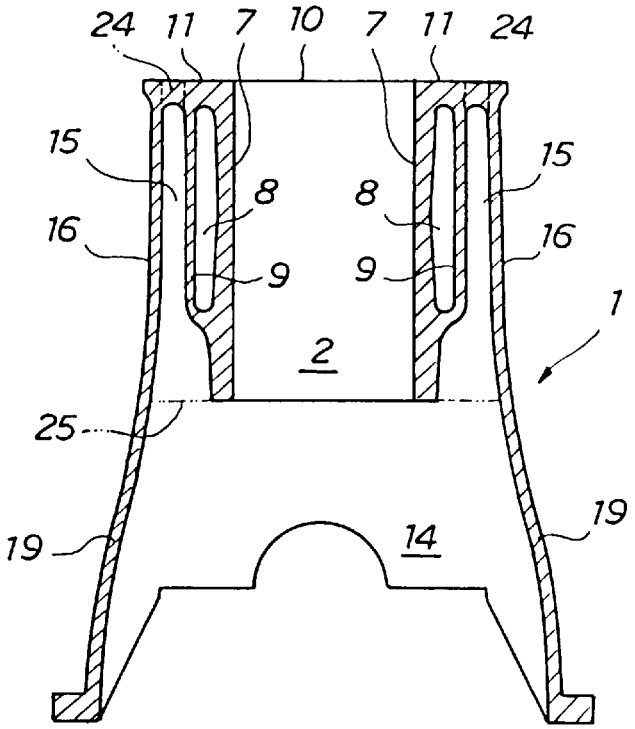
FIG. 3 illustrates a cross sectional view of the cylinder block shown in FIG. 1 as taken along the III—III line.

As illustrated in FIG. 3, the water jacket 8 extends between the cylinder bore walls 7 and an inner wall 9 of the cylinder block 1. The upper end of the water jacket 8 is closed by a lid member 11 embedded in a top deck 10 of the cylinder block 1, thereby providing a so-called closed top structure. This can also be understood from FIG. 1.

Figure 2:
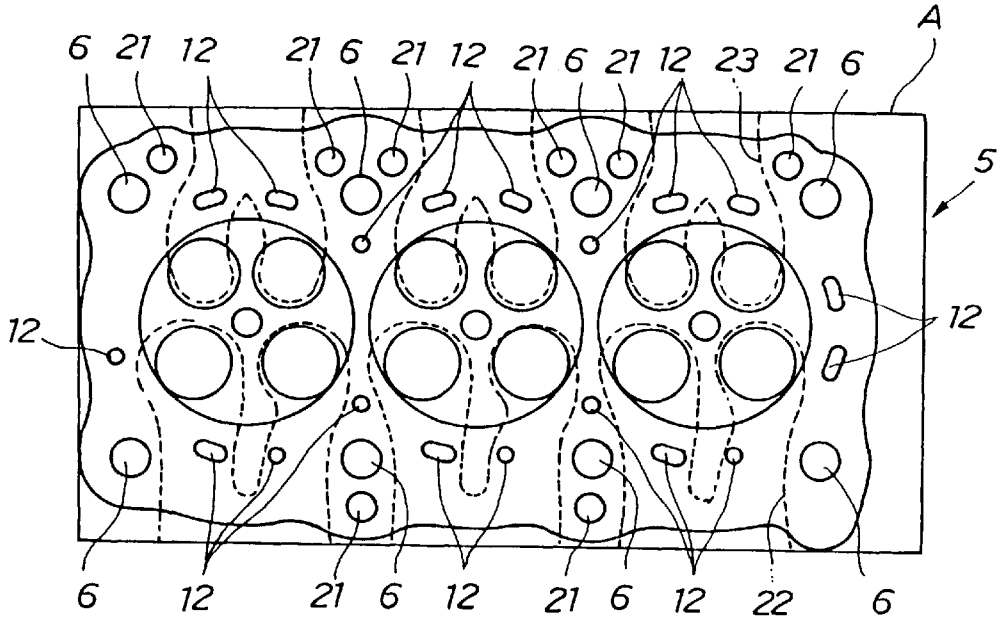
FIG. 2 illustrates a bottom view of a cylinder head to be mounted on the cylinder block shown in FIG. 1.

Referring FIGS. 1 and 2, the lid portion 11 has a plurality of holes 13 which mate with a plurality of cooling water passages 12 formed in the cylinder head 5. It should be noted that "A" of the cylinder head 5 (FIG. 2) contacts "A'" of the cylinder block (FIG. 1) when assembled.

As illustrated in FIG. 1, a plurality of oil dropping passages or chutes 15 are formed around the water jacket 8. As appreciated from FIG. 3, the oil chutes 15 communicate the cylinder head 5 with a crankcase 14. These oil chutes 15 are defined between the inner wall 9 and outer wall 16 of the cylinder block 1, and serve as passages for allowing an oil to drop from the cylinder head 5 to the crankcase 14 and for allowing a blow-by gas to flow up to the cylinder head 5 from the crankcase 14.

As shown in FIG. 1, the oil chutes 15 are formed between the intermediate marginal areas 17. In other words, two oil chutes 15 are provided between each two bolt holes 3 in the illustrated embodiment. Each of the oil chutes 15 is shaped like an arcuate oval when viewed from the top, with its major axis extending generally along the periphery of the water passage 8. Reference numeral 18 is assigned to areas between the intermediate marginal areas 17 (or between the cylinder head bolt holes 3).

As shown in FIG. 3, the outer wall 16 is elongated downward to form a skirt 19 of the crankcase 14. The outer wall 16, therefore, defines an outer surface of the cylinder block 1. Thus, the illustrated cylinder block 1 has a double-wall (inner and outer walls 9 and 16) structure in the marginal areas 18 between adjacent head bolt holes 3.

Referring to FIG. 4, however, the cylinder block 1 has a single wall structure in the vicinity of the head bolt holes 3. Specifically, the inner wall 9 only exists for the water jacket 8.

As illustrated in FIG. 1, a plurality of grooves 20 are formed in the top deck 10 of the cylinder block 1 near the head bolt holes 3 so that they connect adjacent oil chutes 15. As appreciated from FIGS. 1 and 2, the oil chutes 15 of the cylinder block 1 communicate with oil chutes 21 of the cylinder head 5 via these grooves 20 when the cylinder head 5 is mounted on the cylinder block 1. The cross sectional view of the groove 20 is illustrated in FIG. 4. The oil drops to these grooves 20 from the cylinder head 5 and flows into the oil chutes 15 of the cylinder block 1. The grooves 20 are located at the illustrated positions of the cylinder block 1 because the oil chutes 21 of the cylinder head 5 should avoid air intake and exhaust ports 22 and 23 formed in the cylinder head 5 and their locations are limited to in the vicinity of the head bolt holes 6 as understood from FIG. 2.

It should be noted that if the locations of the oil chutes 15 of the cylinder block 1 are first fixed, then the locations of the oil chutes 21 of the cylinder head 5 would preferably be just above the oil chutes 15 of the cylinder block 1. (In this case, the grooves 20 are unnecessary.) In actuality, however, the intake and exhaust ports 22 and 23 occupy the areas above the oil chutes 15 as appreciated from FIGS. 1 and 2. Consequently, the vertical oil passages 21 of the cylinder head 5 are deviated from the vertical oil chutes 15 of the cylinder block 1. The short horizontal grooves 20 connecting the vertical oil chutes 15 and 21 with each other are thus needed in the top deck 10 of the cylinder block 1 as shown in FIG. 1.

Bridges 24 are provided over the oil chutes 15 such that they are coplanar to the top deck 10. The bridges 24 add a certain amount of area to a contact surface of the cylinder block 1 with the cylinder head 5. The bridges 24 extend in the width direction of the cylinder block 1. The cross sectional view of the bridge 24 is seen in FIG. 3. In the height direction of the cylinder block 1, each of the bridges 24 may extend a whole length of the cylinder bore 2 from the top deck 10 down to a point as indicated by the phantom line 25. In this construction, the bridges 24 function as ribs for reinforcement, particularly in an axial direction of each cylinder bore 2. Deformation of the bores 2 is therefore restricted.

As illustrated in FIG. 2, the number of the oil dropping passages 21 on the upper edge of the cylinder head 5 (on the exhaust ports 23 side) is greater than that on the lower edge (on the intake ports 22 side) because the exhaust ports 23 are subjected to severer thermal conditions than the intake ports 22. For the same reason, the cooling water passages 12 on the exhaust ports 23 side have larger areas than those on the intake ports 22 side.

Now, working or operations of the cylinder block 1 will be described.

Figure 6:
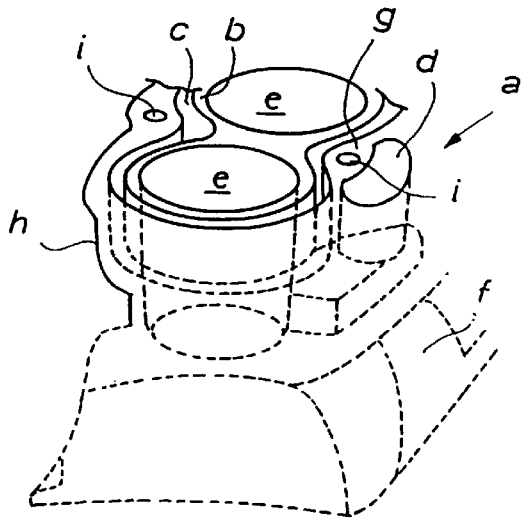
FIG. 6 illustrates a perspective view of a conventional cylinder block.

Combustion noises produced in the cylinder bores 2 are attenuated by the layer of cooling water in the water jacket 8 and further absorbed by the layer of air in the oil chutes 15. Therefore, noises directed to the outside from the engine are reduced. It is particularly noted here that the air layer in the oil chutes 15 serve as a sound insulating layer for the noises generated in the cylinder bores 2. In the illustrated embodiment, the oil chutes 15 are formed in the marginal areas 18 between the head bolt holes 3, and two arcuate oil chutes 15 are arranged for each of the cylinder bores 2 such that they circularly surround the associated cylinder bore 2. The oil chutes 15 can therefore absorb the combustion noises generated from the cylinder bores 2 effectively. Referring to FIG. 6 illustrating the conventional cylinder block, on the other hand, the oil chutes d do not surround the cylinder bores e and consequently the noise insulation cannot be expected.

Although heat is radiated (or lost) from the cylinder bore walls 7 to the atmosphere via the water flowing in the water jacket 8 after the engine operation is initiated, this heat is insulated by the air layer formed in the oil chutes 15. Thus, warming up capability of the engine is improved, particularly when an environmental temperature is low. Specifically, when the engine is started under a cold condition, the air in the oil chutes 15 functions as the heat insulating layer to the water jacket 8 (or the water flowing in the water jacket 8). Therefore, heat radiation to the outside (atmosphere) from the cooling water (water jacket 8) is reduced. Accordingly, the engine is warmed up relatively quickly. The oil chutes 15 which form the heat insulating layer extend along the water jacket 8 which radiates the heat so that high heat insulation performance can be expected. It should be noted that slow warming up of the engine is one of the conventional problems associated with aluminum cylinder blocks since the aluminum radiates the heat very quickly. The present invention can overcome this drawback.

Further, since the oil chutes 15 are formed between the head bolt holes 3 and each of the oil chutes 15 has an oval shape with its major axis extending along the periphery of the water jacket 8 so that it is thin in the width direction of the cylinder block 1 (up and down directions in FIG. 1), the cylinder block 1 need not swell out unlike the conventional arrangement shown in FIG. 6. As a result, it is possible to effectively utilize the space in an engine room. In addition, it is unnecessary to consider interference with bulk heads partitioning the cylinder bores 2. Accordingly, it is feasible to design the cylinder block 1 in a smaller size and advantageous in determining the location of the engine in the engine room.

Since the grooves 20 are formed in the top deck 10 of the cylinder block 1 to communicate the oil passages 21 of the cylinder head 5 with the oil chutes 15 of the cylinder block 1, a freedom in determining the locations of the oil passages 21 of the cylinder head 5 is increased. In other words, even if the vertical oil chutes 21 of the cylinder head 5 do not match the vertical oil chutes 15 of the cylinder block 1 upon assembling, the oil is caused to drop to the cylinder block 1 from the cylinder head 5.

Since the bridges 24 over the oil chutes 15 are coplanar with the top deck 10 of the cylinder block 1, a gasket (not shown) to be interposed between the cylinder block 1 and cylinder head 5 can transmit a pressure to the cylinder head 5 in a relatively wide area. This improves the sealing between the cylinder block 1 and cylinder head 5.

The present invention is not limited to the illustrated and described embodiment. For example, the cylinder block structure of the invention may be applied to an engine having four or more cylinders in line or V-type engines. The material of the cylinder block may be cast iron. The grooves 20 may be dispensed with if unnecessary.

The illustrated and described cylinder block structure is disclosed in Japanese Patent Application No. 10-4144 filed Jan. 12, 1998 with JPO, and the entire disclosure thereof is incorporated herein by reference. The subject application claims priority of this Japanese Patent Application.

What is claimed is:

1. A cylinder block structure comprising:

a cylinder block;

a plurality of cylinder bores formed in the cylinder block, with intermediate marginal areas being defined between adjacent cylinder bores;

a single water jacket formed in the cylinder block to surround the plurality of cylinder bores; and a plurality of oil chutes formed in the cylinder block outside the water jacket for allowing an oil to drop from a cylinder head to a crankcase therethrough, the plurality of oil chutes being formed between adjacent intermediate marginal areas generally along the water jacket.

2. The cylinder block structure of claim 1 further including grooves formed in a top deck of the cylinder block in the intermediate marginal areas for guiding the oil dropping on the top deck from the cylinder head into the oil chutes.

3. The cylinder block structure of claim 1 further including a plurality of bridges over the plurality of oil chutes respectively such that the plurality of the bridges are coplanar to the top deck of the cylinder block.

4. The cylinder block structure of claim 3, wherein each of the plurality of bridges extends an entire length of the associated cylinder bore in a height direction of the cylinder block.

5. The cylinder block structure of claim 1, wherein the cylinder block is made of aluminum.

6. A cylinder block structure for an engine, comprising:

a cylinder block;

a plurality of cylinder bores formed in the cylinder block, with intermediate marginal areas being defined between adjacent cylinder bores;

a plurality of cylinder head bolt holes formed in the intermediate marginal areas;

a water jacket formed in the cylinder block to surround the plurality of cylinder bores; and a plurality of oil chutes formed in the cylinder block outside the water jacket for allowing an oil to drop from a cylinder head to a crankcase therethrough, the plurality of oil chutes being formed between adjacent cylinder head bolt holes generally along the water jacket and being not formed in the intermediate marginal areas.

7. The cylinder block structure of claim 6, further including grooves formed in a top deck of the cylinder block in the intermediate marginal areas for guiding the oil dropping on the top deck from the cylinder head into the oil chutes.

8. The cylinder block structure of claim 6, further including a plurality of bridges over the plurality of oil chutes respectively such that the plurality of the bridges are coplanar to the top deck of the cylinder block.

9. The cylinder block structure of claim 8, wherein each of the plurality of bridges extends an entire length of the associated cylinder bore in a height direction of the cylinder block.

10. The cylinder block structure of claim 1, wherein the cylinder block is made of aluminum.

* * * * *